United States Patent [19]

Koller

[11] 4,385,660

[45] May 31, 1983

[54] DEVICE FOR DIVERTING CLEANING BODIES

[76] Inventor: Josef Koller, Ziegeleiweg 26, 4006 Erkrath 2, Fed. Rep. of Germany

[21] Appl. No.: 157,592

[22] Filed: Jun. 9, 1980

[30] Foreign Application Priority Data

Jun. 11, 1979 [DE] Fed. Rep. of Germany ..... 2923659

[51] Int. Cl.[3] ..... F28G 9/00

[52] U.S. Cl. ..... 165/95; 15/3.51

[58] Field of Search ..... 165/95; 15/3.51

[56] References Cited

U.S. PATENT DOCUMENTS

| | | | |
|---|---|---|---|
| 4,135,574 | 1/1979 | Treplin | 165/95 |
| 4,304,295 | 12/1981 | Otake | 165/95 |

FOREIGN PATENT DOCUMENTS

| | | |
|---|---|---|
| 1303750 | 10/1972 | Fed. Rep. of Germany . |
| 2612905 | 5/1978 | Fed. Rep. of Germany . |
| 2438814 | 9/1980 | France . |
| 18-21002 | 9/1943 | Japan . |
| 745556 | 2/1956 | United Kingdom . |

*Primary Examiner*—William R. Cline
*Assistant Examiner*—Theophil W. Streule, Jr.
*Attorney, Agent, or Firm*—Sprung, Horn, Kramer & Woods

[57] ABSTRACT

A device for diverting discrete cleaning bodies carried in a fluid flowing through a tubular heat exchanger from the main stream of the fluid consisting of a diverter casing through which an axial current flows and a separating sieve system disposed therein having at least one sieve surface disposed at an angle to the flow and terminating at the downstream end in a lateral outlet connection. The at least one sieve surface being pivotable for cleaning purposes to such an extent that the sieve surface that was on the upstream side comes to be situated on the downstream side. The at least one sieve surface terminates in the vicinity of the diverter casing wall and a transition surface is disposed between the upstream sieve surface and the casing wall, the radius of curvature or angle between the transition surface and the casing wall being selected such that the cleaning bodies are prevented from becoming wedged.

20 Claims, 12 Drawing Figures

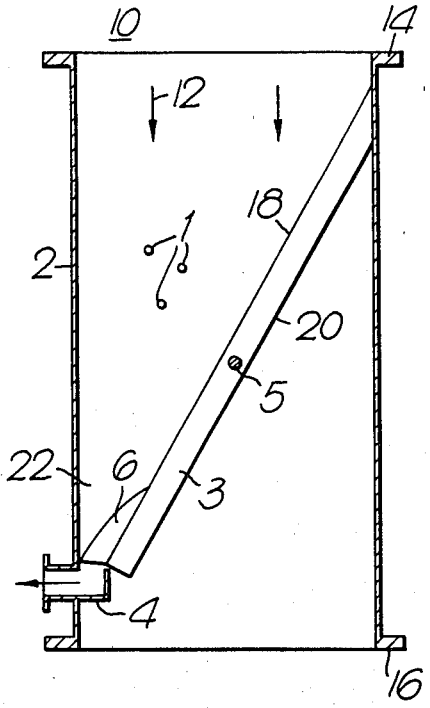
Fig. 1.
Fig. 2.
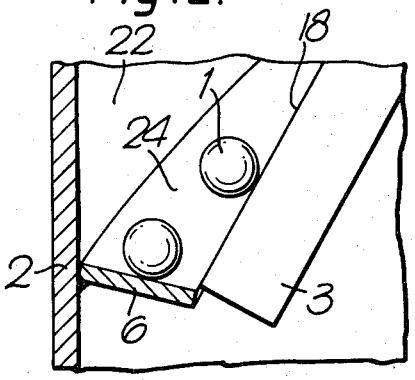
Fig. 3.
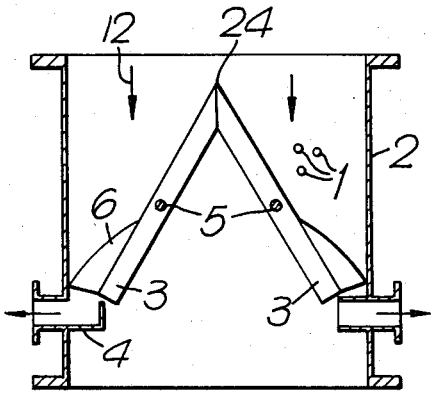

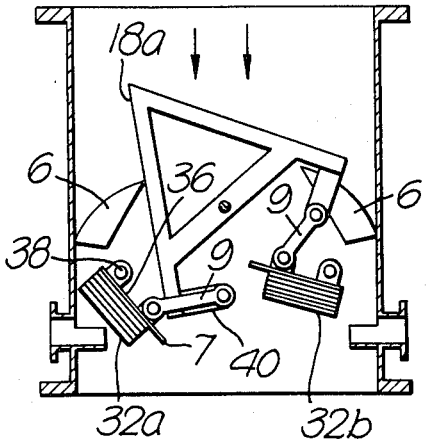
Fig. 7.
Fig. 8.
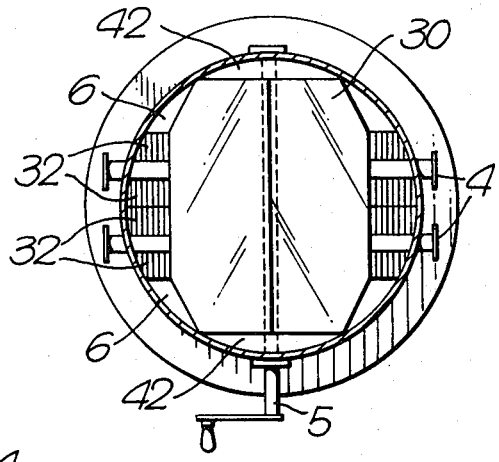
Fig. 9.
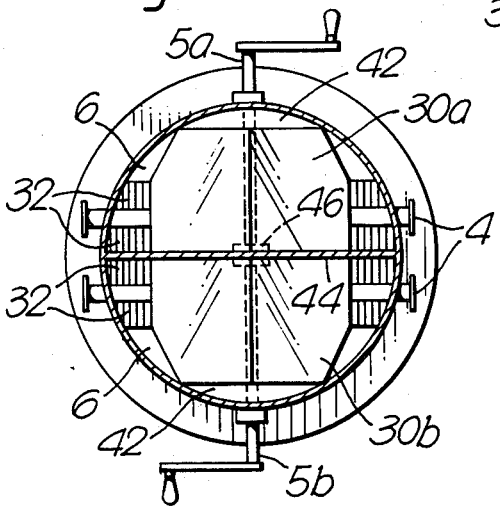
Fig. 10.
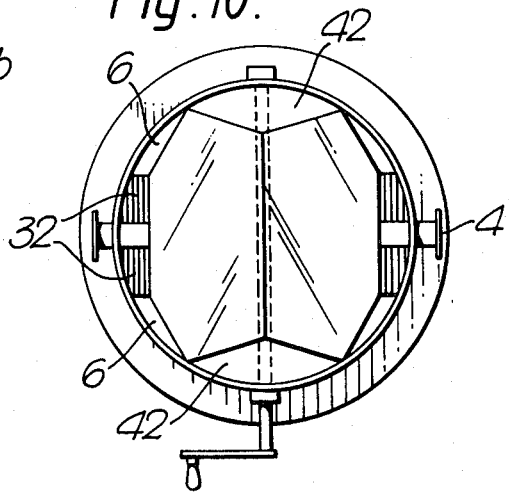

DEVICE FOR DIVERTING CLEANING BODIES

BACKGROUND

The invention relates to a device for diverting discrete cleaning bodies from the main stream of a fluid flowing through a tubular heat exchanger, this device consisting of a diverter casing through which an axial current passes and a separating sieve system disposed therein having at least one sieve surface disposed at an angle to the flow and terminating at its downstream end in a lateral outlet connection, the sieve surface being pivoted for cleaning purposes such that the upstream side of the sieve surface can be changed to the downstream side.

Such an apparatus is already known from German AS No. 1,227,040. Such apparatus are used in self-cleaning tubular heat exchangers operating with cleaning bodies which are forced through the tubes by the medium (cooling water for example) flowing through the tubes, in order to thus scrape away the impurities settling on the walls and thus constantly to keep the heat exchanger clean. Sponge rubber balls or the like are usually used as the cleaning bodies, their diameter being slightly greater than the diameter of the heat exchanger tubes. To be able to remove the cleaning bodies from the heat exchanger fluid, the above-mentioned device is placed in the discharge from the heat exchanger and serves to separate the cleaning balls from the heat exchanger fluid. The cleaning bodies emerging from the lateral outlet connection can then, if desired, be aspirated together with a small portion of the heat exchanger fluid by means of a return pump, and they can be returned through a connecting line into the input line of the tubular heat exchanger.

The known device consists of a tubular casing having a diameter corresponding to the diameter of the heat exchanger outlet line. In this tubular casing there are two sieves, an upper sieve and a lower sieve. The upper sieve is formed by two sieve surfaces extending from the walls at an angle to the direction of flow and merging with one another in the center of the casing to form a kind of hopper through which the cleaning bodies are guided into the lower sieve, while the heat exchanger fluid passes substantially through the openings in the sieve and moves in a substantially unhindered laminar flow through the cylindrical casing. The lower sieve consists of a box which is disposed in the center of the tubular casing and is attached to the horizontal edge of the upper sieve and consists again of sieves disposed in a hopper-like manner with respect to one another. Both the two upper sieves and the lower sieves are each mounted rotatably in the casing and can be rotated from without for the purpose of cleaning the sieve by reverse flushing. Due to the numerous shafts which become necessary for the operation of the different sieves, a great number of openings in the tube are required which, since they have to be provided with packings, make the manufacturing costs great, on the one hand, but on the other hand they also make the apparatus require a great deal of maintenance. Especially in the case of reactor applications, where radioactive substances might be carried in the heat exchanger medium, it is extremely important that the circuit be absolutely leak-proof.

Another disadvantage is that the cleaning bodies gather substantially in the center of the cylindrical casing and from there they first have to be carried over to the casing wall before they can emerge from the casing. In the arrangement represented in FIG. 1 of German AS 1,227,040, of a lateral outlet connection leading radially outwardly, transport problems can arise on account of the sharp turn involved. If the lateral outlet connection is attached at an angle to the direction of flow so as to avoid the sharp bend, the structural length of the apparatus is increased. It would be desirable, therefore, to bring the cleaning bodies together, not in the center of the apparatus, but instead in the vicinity of the outer wall.

A system of this kind is shown in German Patent No. 2,612,905, in which only one sieve surface disposed at an angle to the direction of flow is provided, which terminates at its downstream end in a lateral outlet connection which actually is situated in the vicinity of the wall and therefore greatly facilitates the withdrawal of the cleaning bodies. In this patent, it is also found that the acute angle that develops in this embodiment between the sieve surface and the casing wall can cause the cleaning bodies to become wedged between them. Cleaning bodies which become caught in this manner then usually cause additional cleaning bodies to become entrapped, resulting in the formation of great clusters which then interfere with or even block the exit of the cleaning bodies, and additionally they unacceptably increase the resistance to the flow of the exchange fluid.

German Patent No. 2,612,905 seeks to prevent this wedging of cleaning bodies by making the lateral outlet tube a tube running along the margin of a portion of the elliptical boundary between the sieve surface and the casing wall. A similar construction is also shown in German AS No. 2,612,917 except that here the withdrawal of the cleaning bodies takes place in the center of the casing. In both cases any pile-up of the cleaning bodies is supposed to be largely prevented by the arrangement of the tubes, which are slotted and in which a turbulence is formed by the flow of the exchanger fluid. A disadvantage is in this case to be seen in the fact that the design is again relatively complex, and in particular many difficult welds are required for the purpose of avoiding the creation of dead spots in the pipe connection due to inaccurate workmanship, where cleaning bodies can again pile up, possibly resulting in a change of the conditions of flow and thus additional pile-ups of cleaning bodies, until finally the entire system for the aspiration of the cleaning bodies is stopped up. A design similar to that of German Patent No. 1,227,040 is also seen in German Patent No. 1,303,750; note should also be taken of German Patents Nos. 862,456 and 894,699, which were the first to deal with this process for the self-cleaning of heat exchangers.

SUMMARY OF THE INVENTION

It is the object of the invention to simplify the device for the diversion of cleaning bodies, of the kind mentioned in the beginning, both with regard to its manufacture and with regard to maintenance, without interfering with reverse flushing and without the danger that cleaning bodies might become entrapped in acute angles between converging surfaces.

In accordance with the invention, this object is achieved by the fact that at least one sieve surface terminates in the vicinity of the diverter casing wall (which facilitates the withdrawal of cleaning bodies without increasing the length of the casing), and that there a transition surface is disposed between the upstream side of the sieve and the casing wall, the radius of curvature and the angle at which the sieve surface and transition surface converge on the one hand and the angle between the transition surface and the casing wall on the other being selected such that no wedging of the cleaning bodies will take place. To this end, the radius of curvature should be greater than the diameter of the cleaning bodies. If the transition surface should form a sharp corner with the sieve surface or the casing wall on the other, the angle involved should amount to at least 90° (although under certain circumstances even slightly more acute angles, such as 85° for example, can be used). In this manner any pile-up of cleaning bodies due to entrapment is reliably prevented. The transition surface can be formed by a marginal plate, or also by a sharp bend or concavity or fillet formed on the sieve surface.

To reduce the length of the diverter, it may be desirable to provide two lateral outlet connections, in which case, in an advantageous further development of the invention, two sieve surfaces are provided, which are formed by sieves forming a gable-like apex between them, with the apex on the upstream side.

For the purpose of reverse flushing, the one sieve surface, or also both sieve surfaces if two sieve surfaces are provided, can be disposed for pivoting about an axis. In this design, therefore, only two shafts have to be mounted in the casing of the apparatus, whereas in the state of the art a considerably greater number of axles is required. Advantageously, the present design can also be modified by joining two sieves rigidly together and making them able to pivot together about an axis which then lies substantially on the bisector of the angle formed by the two sieve surfaces. Thus, all that would be required would be only one operating shaft for the reverse flushing, which reduces the number of shaft seals required to two or, if only one end of the shaft is brought through the wall of the pipe, to one.

The sieve surface, the marginal plate and the casing wall desirably form a kind of hopper which empties at its narrower end into the lateral outlet connection. Between this funnel end and the lateral outlet connection, in accordance with an additional embodiment of the invention, a second (lower) sieve can be provided, which can be of an essentially hopper-like construction, so disposed that it forms a continuation of the funnel.

It may be desirable also to make this lower sieve (in the case of two or more lateral outlet connections a correspondingly larger number of sieves may be present) also rotatable, so that these sieves also can be cleaned by reverse flushing. In order to avoid having to bring a second shaft through the casing wall, according to still another embodiment a link can be articulated at one end to the narrow end of the lower sieve and at its other end to an inwardly directed projection of the free end of the upper sieve, such that, when the upper sieve is turned from its working position to the cleaning position, the lower sieve will also be turned from from its working position to its cleaning position. Alternatively, the lower sieve could also be rigidly joined to a corresponding upper sieve and thus be rotatable therewith.

This would bring it about that all of the sieves of the system, whether they be one upper and one lower sieve or a plurality of upper sieves and one or more lower sieves, would be able to be rotated for cleaning by means of only one operating shaft, so that in some cases only one opening would have to be made in the casing wall.

The above-mentioned arrangement of four lateral outlet connections, two at the downstream end of each of the sieve surfaces forming a gable-like apex, makes possible an additional reduction of the length of the diverter casing, especially if lower sieves are present. Furthermore, in the case of four lateral outlet connections, a partition can be provided in the tube, which divides the upper, gable-shaped sieve into two halves; this improves the stability of the system and also permits an additional mounting for the operating shaft in this tube partition. By means of this additional mounting it is even possible also to divide the operating shaft and divide the entire system into two halves of a diverter which can be reverse flushed independently of one another.

Also, four upper sieves forming two "gables" can be disposed pivotingly, side by side, the inner, upper sieves opening into a lower, funnel-like sieve, and the latter opening into one or more lateral outlet tubes. The lower sieve can be rigidly joined to the one adjacent sieve surface and can be rotatable therewith, or it can consist of a plurality of parts, e.g., two, one part being able to be joined to the one adjacent upper sieve, and the other part with the other upper sieve, or also with the lateral outlet tube or the casing wall.

BRIEF DESCRIPTION OF THE DRAWINGS

The invention is further explained hereinbelow with the aid of embodiments which are represented in the drawings, wherein:

FIG. 1 is a schematic longitudinal cross section through a device for the diversion of cleaning bodies, which has the margin plate of the invention, this embodiment thereof having a single pivoted sieve, FIG. 2 is a detail of the margin plate of the invention, FIG. 3 is a design similar to that of FIG. 1, but has two lateral outlet connections and two separating sieves disposed in a gable-like configuration, FIG. 7 shows the system of FIG. 5 in a position wherein the sieves are pivoted for reverse flushing, FIG. 8 is a diagrammatic top view of a system similar to that of FIG. 5, but two pairs of hopper-like lower sieves are provided on each side for the purpose of reducing the structural length, FIG. 9 is a representation similar to FIG. 8, but with a partition wall dividing the tube, FIG. 10 is a representation similar to FIG. 6, but with a reduced ridge length for the purpose of enlarging the achievable pivoting angle.

DETAILED DESCRIPTION OF THE INVENTION

Figure 4:
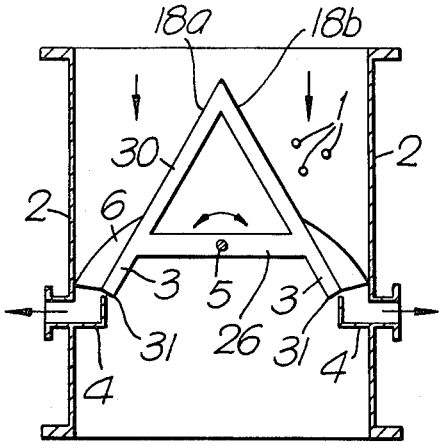
FIG. 4 is a design similar to that of FIG. 3, but has sieves in an integral arrangement for the purpose of common pivoting about a single axis.

In FIG. 1, there is shown an especially simple form of the device 10 for the diversion of discrete cleaning bodies 1 from the main stream of a medium flowing through a heat exchanger, the flow of this main stream being indicated by the arrows 12. As previously stated, the cleaning bodies 1 serve to free the tubes of the heat exchanger (not shown) of deposits or to prevent such deposits from forming, so that the medium containing the cleaning elements effects an automatic cleaning of the apparatus. The cleaning bodies consist usually of sponge rubber balls having a diameter that is slightly greater than the diameter of the heat exchanger tubes. Other materials can, of course, be used for the cleaning bodies, such as plastic foam material. It is important only that the cleaning bodies have approximately the same specific gravity during operation as the heat exchanger medium, so that undesirable separation will not take place. The diverter 10 of the invention in the embodiment represented in FIG. 1 comprises a diverter casing 2 of cylindrical construction, which desirably has the same diameter as the line coming from the heat exchanger (not shown), to which the upper end (input end) of the diverter casing 2 can be attached sealingly by means of a flange 14. The bottom end (outlet end) of the casing 2 is also joined sealingly by a flange 16 to a pipeline of the same diameter constituting the continuation of the heat exchanger circuit.

A separating sieve 3 serves for the diversion of the cleaning elements 1 carried in the heat exchanger medium, and is disposed in the axial casing at an angle to the direction of flow 12 such that the cleaning bodies 1 are guided towards a lateral outlet connection 4 through which they can be discharged by means of systems not indicated. The shape of the separating sieve 3 is elliptical so as to fit precisely to the cylindrical wall of the diverter casing 2. The separating sieve 3 has openings which are so small that the cleaning elements 1 will be unable to pass through them even in spite of their softness. On the other hand, the permeability of the sieve is to be so great that no substantial impairment of the axial flow 12 through the sieve 3 will be produced.

During operation, foreign bodies may become entrapped on the sieve surface, resulting in an increase of its resistance to flow that may impair operation. To permit the removal of these foreign bodies, the separating sieve 3 can be pivoted about an operating shaft 5 to a reverse flushing position (not shown), in which the sieve surface 18 which normally faces upstream shifts to a position facing downstream, while at the same time the sieve surface 20 which was previously on the downstream side is brought to the upstream side. The stream flowing through the sieve then washes away the foreign body deposited on the surface 18. Then the sieve 3 is returned to the normal position represented in FIG. 1.

So that the angle of convergence formed between the sieve surface 18 and the inside wall surface of the diverter casing 2 will not produce any wedging and piling up of cleaning bodies 1, a transition surface in the form of a margin plate 6 is provided between the sieve surface 18 and the inside wall 2 of the casing such that an excessively acute angle will not be formed between the upstream sieve surface 18 and the upstream surface 24 of the margin plate, on the one hand, and between this surface 24 and the casing wall surface 22 on the other. Preferably, a convergence angle of at least 90° is selected. Such a convergence angle assures that cleaning bodies will not become wedged and held in the area where they leave the sieve surface 18; see also FIG. 2 which gives this area in greater detail. The margin plate can be planar or curved, and in the latter case the radius of curvature should be greater than the radius of the largest cleaning body that is to be diverted. The planar transition surface, or the transition surface curved in the stated manner, can be formed also by a bend in the sieve surface or by a concavity or a fillet at the margin of the sieve surface (not illustrated).

The design represented in FIG. 1 has also the disadvantage that it has a relatively great length. FIG. 3 shows a design that is improved in this regard, which has not just one separating sieve 3 but two separating sieves with corresponding lateral outlet connections and margin plates 6. The two separating sieves 3 are pivoted independently of one another about axes 5 and in normal operation they are so disposed that they form a gable having a ridge 24 on the upstream side. Otherwise the manner of operation is quite similar to the one described in connection with FIG. 1.

The location of the axis 5 is best such that the pressure developed by the flow 12 and the flow resistance of the sieve 3 will be equally divided between the two lever arms, so that the flow 12 will not produce on sieve 3 any torque tending to pivot it about the axis 5. The location might also, however, be made such that a slight torque will be produced in the direction of the working position of sieve 3, so that a kind of self-locking of the sieve 3 in the working position is achieved. On account of the high flow velocities commonly used nowadays, a slight displacement of the axis 5 from the neutral position will suffice to achieve the desired self-locking effect, while on the other hand the sieve 3 will be able to be turned toward the reverse flushing position without the application of a great deal of torque to the axis 5 while the medium is flowing.

As a comparison between FIGS. 1 and 3 will show, the arrangement of two sieves permits a considerable reduction of the length of the diverter casing 2 for the same casing diameter. The disadvantage accepted in that case is that two shafts 5 must be provided, which complicates the operating system and also necessitates the provision of at least two shaft seals, which increases maintenance problems. FIG. 4 shows another embodiment in which these problems are not encountered. For this purpose the two individual sieves 3 which are seen in FIG. 3 are combined to form a single gable-shaped sieve 30 by uniting the upper ends of the individual sieves 3 and holding the lower ends apart by means of a strut 26. On account of the fixed joining together of the two sieve parts 3 to form a one-piece sieve 30, only one shaft 5 is required to enable the sieve assembly 30 to be pivoted for reverse flushing. If the sieve surface **18*a* is to be flushed, the sieve 30 is rotated counterclockwise about the axis 5 until the surface 18*a* of the sieve is on the downstream side. Vice versa, the sieve 30 must be rotated in the clockwise direction if the sieve surface 18*b* is to be reverse flushed. The arrangement of the margin plates 6 is to be such that the sieve 30 will be able to be rocked past the margin plates 6. Furthermore, the pivot point 5 must be so located that the bottom end 31 of the two sieve parts 3 will not, or at least not yet, touch the inside wall of the casing 2 when the opposite sieve part 3 just reaches the flushing position. The axis of rotation 5, which is best located on the bisector of the angle formed between two surfaces 18*a* and 18*b*, must therefore not be situated too far from the imaginary line joining the two surfaces 31**, but on the other hand the pivot point must not be too close to this line, so as to avoid an excessively long pressure lever arm.

The design represented in FIG. 4 also makes it possible to provide so-called lower sieves, which are advantageous in certain applications, and are already in use in the state of the art. To avoid the necessity of additional pivot shaft holes when lower sieves are used which are likewise to be reverse flushed, a lever design is provided in accordance with FIG. 5, which produces, when the upper sieve 30 is turned for reverse flushing, a corresponding turning of the lower sieve to the reverse flushing position.

Such lower sieves can also be provided in the case of the design represented in FIG. 3, the lower sieves 32 being rigidly joined to the corresponding upper sieve 3 and being turnable therewith for the purpose of reverse flushing. Here, however, the reverse flushing position of the lower sieve is slightly less advantageous than in the design shown in FIG. 5, but the system is simpler.

Figure 5:
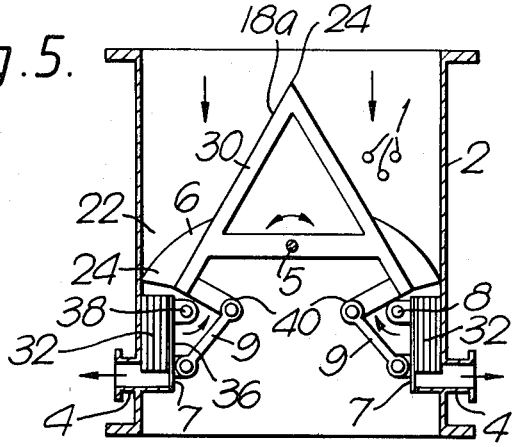
FIG. 5 shows an arrangement similar to that of FIG. 4, but having lower sieves which can be pivoted together with the upper sieves.
Figure 12:
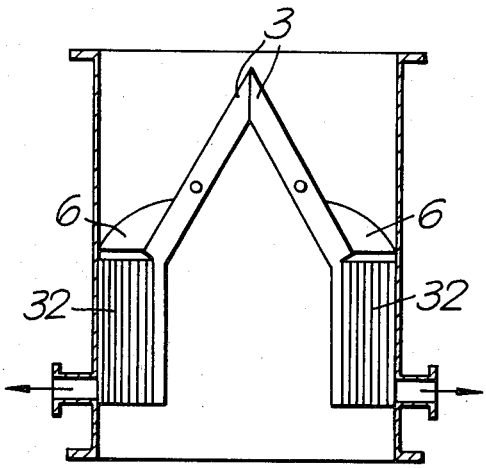
FIG. 12 is a representation similar to FIG. 3, but having lower sieves rigidly joined to the upper sieves.

In the embodiment represented in FIG. 5 (see also FIG. 6), as in the case in the system shown in FIG. 12, the sieve surface 18*a* (3 in FIG. 12) forms together with the inside wall 22 of casing 2 and the surfaces 24 of the margin plate 6 consisting of two parts, a kind of hopper which at its bottom end merges with a second hopper which is formed by the sieve surfaces 34 of the lower sieve and by the inside wall 22 of casing 2 and an additional surface 36 which supports the two sieve surfaces 34 of the lower sieve 32. This surface 36 can be a solid plate or another sieve surface. The outlet opening of the hopper formed by the lower sieve 32 opens into the lateral outlet connection 4.

Figure 6:
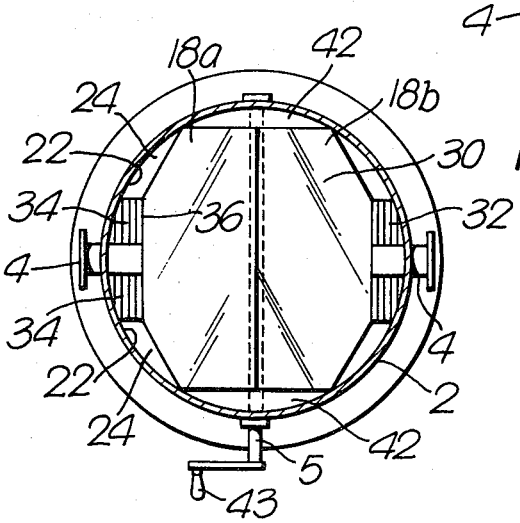
FIG. 6 shows a diagrammatic top view of the arrangement shown in FIG. 5.

In the embodiment shown in FIGS. 5 and 6, the surface 36 which supports sieve surface 34 is pivoted at its one (upper) end on a shaft 38 appropriately fastened to the inner casing wall, while a lever 9 is articulated to the other end of surface 36, whose other end is linked to a projection 40 of the sieve 30. This linkage is so devised that, when the sieve 30 is turned for the flushing, for example, of sieve surface 18*a* (see FIG. 7), at least one of the two lower sieves (in FIG. 7 it is the lower sieve 32*b*) will, if desired, shift to the reverse flushing position. The other lower sieve (32*a*) will reach its reverse flushing position when the upper sieve 30 is turned to the flushing position in which sieve surface 18*b* is cleaned (not shown in FIG. 7).

The design shown in FIG. 7, which consists of a gable-like upper sieve 30 and two hopper-like lower sieves 32 can thus be brought into the reverse flushing position by a single pivot shaft 5; a hand crank 42 is operated for this purpose, or else an appropriate machine drive which is not shown might be actuated.

It is important that only one through-opening is required in the wall of the casing 2 for this drive, while all other bearings can be provided in the form of devices mounted on the inside wall of the casing which require no openings through the casing and therefore result in no sealing problems.

It should also be noted that the surface 36 can have a projection 7 for the purpose of providing a back wall for the lateral outlet connection 4 when the lower sieve 32 is in the working position.

As clearly seen in FIG. 6, the sieve surfaces 18*a*, 18*b*, are not curved in the areas near the casing wall, but are rectilinear, and an additional margin plate 42 is provided between the edge of the sieve surface 18*b* and the casing wall to close the opening thus produced, in order to permit pivoting in both directions. The pivoting angle can be further increased if, as in FIG. 10, the length of the ridge 24 is reduced and the additional margin plates 42 are correspondingly widened, which might become necessary especially in the case of a very steep sieve inclination, in order to permit the sieves to be turned all the way to the reverse flushing position.

As it is also apparent in FIG. 7, the lower end of the sieve surface 18*a* (marked 32 in FIG. 4) must be able to swing freely downward, and this has to be allowed for in the design of the linkage, especially the link 9. If necessary, the linking lever 9 must have an appropriate curvature in order to permit the sieve surface 18*a* to swing downwardly.

A still greater reduction of the structure length can be achieved when hopper-like lower sieves are used if, as shown in FIG. 8, two lateral outlet connections 4 are provided on each side, each of which has its own hopper-like lower sieve 32, so that a total of four lower sieves 32 are present.

This arrangement shown in FIG. 8 can be further developed in accordance with FIG. 9 by providing a partition wall 44 perpendicular to the pivot axis 5 such that it separates the two lower sieves 32 from one another on each side, and also divides the upper sieve 30 into two partial sieves 30*a* and 30*b*. This design is desirable especially in the case of the larger pipe diameters. FIG. 9 shows an embodiment having an additional bearing 46 for shaft 5 in the partition wall 44, so that the shaft 5 could be divided at this bearing 46 into two independently operated shafts 5*a* and 5*b*. Of course, a continuous shaft 5 having only one drive is also possible.

Figure 11:
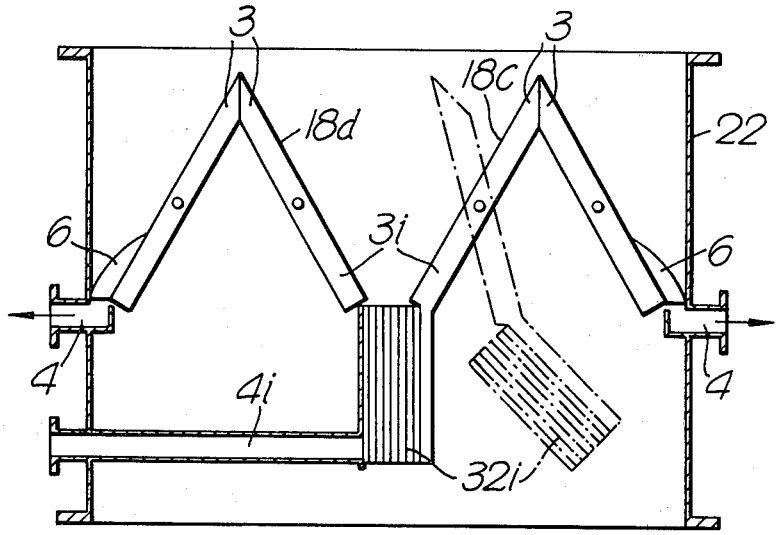
FIG. 11 is a representation similar to FIG. 3, but with four upper separating sieves and a centrally disposed lower sieve.

A shorter diverter length can also be achieved by the design shown in FIG. 11, in which four upper sieves 3 are disposed side by side, thus forming two "gables." The two inner upper sieves 3*i* divert the balls into a lower sieve 32*i* tapering hopper-like downwardly, which is rigidly joined to the upper inside sieve 3*i* except for the one sidewall 50, and can be pivoted with sieve 3*i*, while the sidewall 50 can be joined either to the other upper inside sieve 3*i* or, more simply, to the casing wall or to the lateral outlet pipe 4*i* for the cleaning bodies which gather in the lower sieve 32*i*.

Instead of the margin plates 6, other means can be used for providing a transition surface between sieve 3 and casing wall 22, which will prevent the entrapment of cleaning bodies, such as bulges in the inside wall of the pipe, turned edges on the sieve, and the like.

It will be appreciated that the instant specification and claims are set forth by way of illustration and not limitation, and that various modifications and changes may be made without departing from the spirit and scope of the present invention.

What is claimed is:

1. In a device receptive discrete cleaning bodies carried in a fluid flowing through a tubular heat exchanger for diverting the bodies from the main stream of the fluid of the type having a diverter casing through which an axial current flows, a separating sieve system disposed therein having at least one sieve surface disposed at an angle to the flow and terminating at the downstream end in an outlet connection lateral to the wall of said casing, the at least one sieve surface being pivotable for cleaning purposes from a position facing upstream to a position facing downstream, the improvement wherein the at least one sieve surface terminates in the vicinity of the diverter casing wall when pivoted into the upstream facing position with the sieve at a generally acute angle with respect to the casing wall, and further comprising means forming a transition surface between said at least one sieve surface and the casing wall when pivoted into the upstream facing position which diverges from the generally acute angle such that the radius of curvature or angle between the transition surface and the casing wall prevents the cleaning bodies from becoming wedged between the sieves surface and the casing wall.

2. The device of claim 1, wherein the radius of curvature is greater than the radius of the cleaning bodies or the angle amounts to at least 90°.

3. The device of claim 1, wherein the means forming the transition surface comprises a marginal plate.

4. The device of claim 1 or claim 2, wherein the means forming the transition surface comprises one of a sharp bend, concavity or fillet on the sieve surface.

5. The device of claim 1, wherein two sieve surfaces are provided formed by sieves arranged in a gable-like configuration with the ridge of the gable on the upstream side.

6. The device of claim 5, further comprising means rigidly joining the two sieves together and means mounting the two sieves for rotation about an axis which is situated substantially on the bisector of the angle formed by the two sieve surfaces.

7. The device of claim 6, wherein the means joining the free ends of the sieves disposed at angles to one another comprise struts and the mounting means comprises a shaft carried by the struts.

8. The device of claim 3, further comprising a lateral outlet in the casing and wherein the sieve surface, the marginal plate and the casing wall form a hopper which opens at its narrower end into the lateral outlet connection.

9. The device of claim 8, further comprising a second substantially hopper shaped sieve disposed between the hopper end and the lateral outlet which forms a hopper prolongation and whose outlet end opens into the outlet.

10. The device of claim 9, further comprising means mounting the lower sieve at its broader end for pivotal movement comprising a pivot shaft fastened to the casing wall and disposed parallel to the pivot axis of the first sieve.

11. The device of claim 10, wherein the mounting means further comprises a drive lever articulated at one end to the narrower end of the lower sieve and an inwardly directed projection of the free end of the upper sieve connected the other end of the lever to effect a turning of the lower sieve from the working position to the cleaning position when the upper sieve is turned from the working to the cleaning position.

12. The device of claim 9, wherein the second hopper-like sieve is rigidly connected to the first sieve and is rotatable therewith.

13. The device of claim 12, further comprising two lateral outlets at the downstream end of the sieve surfaces forming a gable.

14. The device of claim 3, wherein a hopper-like lower sieve is provided for each lateral outlet.

15. The device of claim 13 or 14, further comprising a pipe partition wall dividing the upper gable-like sieve into two sieve halves.

16. The device of claim 15, wherein the pipe partition wall has a bearing for the shaft.

17. The device of claim 16, wherein the shaft is divided at the bearing into two shafts each rotatable independently of one another for the independent reverse flushing of the upper sieve halves and of the lower sieves.

18. The device of claim 17, wherein four individually pivotable sieve surfaces are provided and are gable-like in the separating operation, the two inner sieve surfaces opening into a second sieve which has a hopper-like profile in the direction of the pivot axis and a hopper-like or rectangular profile perpendicular thereto, the hopper end opening into a withdrawal tube for cleaning bodies.

19. The device of claim 18, wherein the second sieve is rigidly joined to one of the sieve surfaces.

20. The device of claim 19, wherein the second sieve is multipartite and one portion is joined to the one inner sieve surface and other parts are joined to the other inner sieve surface, the withdrawal tube or the casing wall.

* * * * *